US010737865B1

(12) United States Patent
Sooklaris

(10) Patent No.: US 10,737,865 B1
(45) Date of Patent: Aug. 11, 2020

(54) ARTIST'S CANVAS CARRIER

(71) Applicant: John Sooklaris, San Diego, CA (US)

(72) Inventor: John Sooklaris, San Diego, CA (US)

( * ) Notice: Subject to any disclaimer, the term of this patent is extended or adjusted under 35 U.S.C. 154(b) by 0 days.

(21) Appl. No.: 15/954,502

(22) Filed: Apr. 16, 2018

(51) Int. Cl.
*B65D 81/05* (2006.01)
*B44D 3/00* (2006.01)

(52) U.S. Cl.
CPC ..... *B65D 81/053* (2013.01); *B44D 3/00* (2013.01)

(58) Field of Classification Search
USPC ..... 206/449, 451, 452, 453, 454, 1.7; 40/735, 721, 734, 783, 785, 780, 779, 40/781
See application file for complete search history.

(56) References Cited

U.S. PATENT DOCUMENTS 1,669,214 A * 5/1928 Schulz ..... B65D 61/00 206/449
2,038,890 A * 4/1936 Crampton ..... B44D 3/185 160/187
2,839,857 A * 6/1958 Teller ..... A47G 1/06 40/721
2,869,263 A * 1/1959 Dillen ..... F16B 7/0446 40/781
3,425,147 A * 2/1969 Marx ..... A47F 11/02 40/780
3,514,886 A * 6/1970 Drakard ..... A47G 1/0605 40/766
4,446,968 A * 5/1984 Bremer ..... B44D 3/185 16/410
4,729,183 A * 3/1988 Tarter ..... A47G 1/0605 40/766
5,243,777 A * 9/1993 Dedlow ..... A47G 1/0605 40/757
5,595,301 A * 1/1997 Putz ..... B65D 25/10 206/449
5,987,794 A * 11/1999 Lavi ..... G09F 15/0006 40/490
6,490,818 B1 * 12/2002 Bramhall ..... A47G 1/065 116/323
6,789,674 B2 * 9/2004 Allison ..... B65D 81/107 206/448
7,219,795 B2 * 5/2007 Poux ..... B44D 7/00 206/1.7
7,717,393 B2 * 5/2010 Edgmon ..... A47B 97/08 206/1.7
9,032,654 B2 * 5/2015 Wilcoxen ..... A63F 1/02 40/766
9,162,521 B2 10/2015 Dietrich
(Continued)

*Primary Examiner* — Jacob K Ackun
(74) *Attorney, Agent, or Firm* — Thomas M. Freiburger

(57) ABSTRACT

A carrier for artists' painting panels or stretched canvases allows wet paintings to be transported in a protected way, important for use by plein air painters and also for protecting finished paintings. A series of frame bars can easily be assembled by their corners in the field to form a frame that can carry at least two painted panels or stretched canvases. The frame bars are universal in that each can be used with another of any length, so that one can select from among a collection of bars of various lengths to assembly a frame of a needed size. The frame holds at least two painted canvases arranged face-to-face. Corners can be secured together by different means. The canvases are held securely in place in the frame.

16 Claims, 13 Drawing Sheets

(56) References Cited

U.S. PATENT DOCUMENTS

| | | | | |
|---|---|---|---|---|
| 9,370,964 | B2 | 6/2016 | Dietrich | |
| 9,586,436 | B2 * | 3/2017 | Evers | B44D 3/185 |
| 2009/0307953 | A1 * | 12/2009 | Ahlstrom | A47G 1/0605 40/721 |

* cited by examiner

ARTIST'S CANVAS CARRIER

BACKGROUND OF THE INVENTION

The invention relates generally to apparatus for artists, and more specifically to a carrier for transporting paintings, such as wet paintings, in a secure and protected manner.

Unframed artworks often have to be transported, and this is particularly true with plein air painting. The artist carries painting gear including canvases, paints, brushes, and an easel out into the field, sometimes to a remote location. At the end of a session, there is a need to carry a completed or partially completed wet painting back to the artist's studio, and it is important the painted surface be protected.

Painting carriers, especially for canvas panels, have been available for this purpose. However, they have typically been dedicated to a particular size of painting, or they have been bulky or heavy or not sufficiently secure. Moreover, the painting carriers of the prior art have provided a frame or a box, necessarily larger than the painting or paintings which it is designed to carry, thus causing the artist, when going out into the field, to carry an additional bulky item.

Carriers for artist's paintings are disclosed in U.S. Pat. Nos. 9,370,964 and 9,162,521. See also the websites panelpak.com and raymarart.com. Some of these prior carrier devices were dedicated to specific sizes and could not receive panels slightly oversized, which often occurs.

SUMMARY OF THE INVENTION

The artist's canvas carrier of the invention is small in size and efficient in use, carrying two paintings face-to-face in a frame. Instead of a fixed frame, the carrying frame of the invention is assembled when needed, and can be carried as four clustered together frame bars, easily contained and/or supported in or on the side of a backpack, for example, alongside the canvas(es). The frame bars are produced as pairs of a plurality of different lengths, so that, for example, if the artist is to be transporting 12×16 inch canvas panels, he simply selects a pair of 12 inch frame bars and a pair of 16 inch frame bars. When a wet painting (or any painting) is to be transported, the artist secures some of the frame bars together at corners, such as three of the frame bars. The painting or paintings are then slid into the frame via grooves in the carrier frame bars, and the final frame bar is then connected to form the completed carrying frame. The grooves in which reside the edges of a canvas panel are angled or tapered, to a narrower width deeper in the groove, so that the canvas panel will touch the preferably wood frame only at the extreme outside edges of the painting.

Sizes can be mixed and matched, so that if an artist has frame bars for a 9×12 inch painting, but needs a 12×16 inch canvas carrier, the artist need only obtain a pair of 16" bars. In a preferred embodiment the frame bars preferably are produced in typical stretcher bar lengths.

Once the panels are inside the frame, they can be carried in a bag, box, backpack or simply by attaching straps to the frame.

The carrier frame bars each have one "male" and one "female" end, so that any bar can be connected with any other bar. The corners are formed as a tongue-and-groove type assembly, and in one preferred form the corners are secured together via holes passing through the ends of each of the overlapping/interlocking ends at the 90° corner, with a pin through these holes at each corner. The pin can advantageously be a binder post, a two-piece threaded metal connector wherein a bolt piece is screwed into a nut piece through the aligned holes.

During transport the frame holds the panels securely in place, fully protecting them from damage and the painted surfaces from contact with any surrounding objects. Also, air breathing openings are provided in corners, so that air interchange occurs at the painted surfaces.

In a preferred embodiment the carrying frame bars are of pine, light in weight, and about ¾" or less in width. Thus, if needed six artist's panels could be contained within 2¼" of width.

It is an object of the invention to produce a protective transporting device for artist's canvases, especially bearing wet paint, which is lightweight, disassembled and compact between uses, and simple and efficient in construction and use. These and other objects, advantages and features of the invention will be apparent from the following description of a preferred embodiment, considered along with the accompanying drawings.

DESCRIPTION OF PREFERRED EMBODIMENTS

Figure 1:
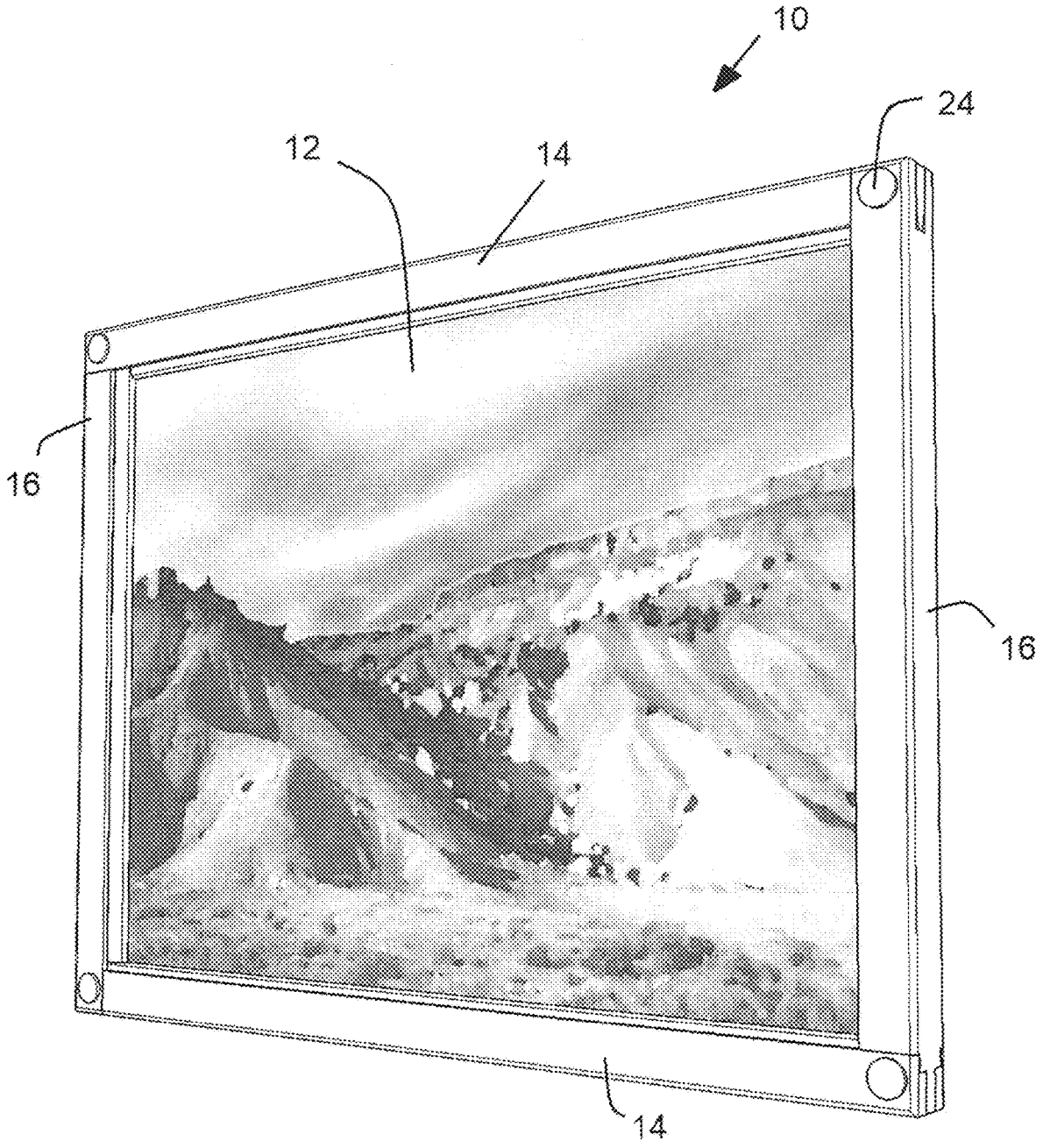
FIG. 1 is a perspective view showing an artist's carrying frame of the invention, showing one painted canvas panel retained in the carrying frame.

FIG. 1 shows an assembled carrying frame 10 for artist's canvases, illustrated with a single painting retained in the frame, facing inwardly in the frame, but typically a second canvas will be retained in the frame parallel to and just forward of the painting 12. The paintings, which can be wet, are retained face-to-face. If only one painting 12 is to be carried, an unpainted canvas or a dry painting can be placed in the second position (or some other flat sheet), so that the surface of the painting 12 is protected.

As mentioned above, the carrying frame 10 can be quickly assembled in the field, as by plein air painters, and is formed of four carrying frame bars, two horizontal bars 14 and two vertical bars 16.

Figure 2:
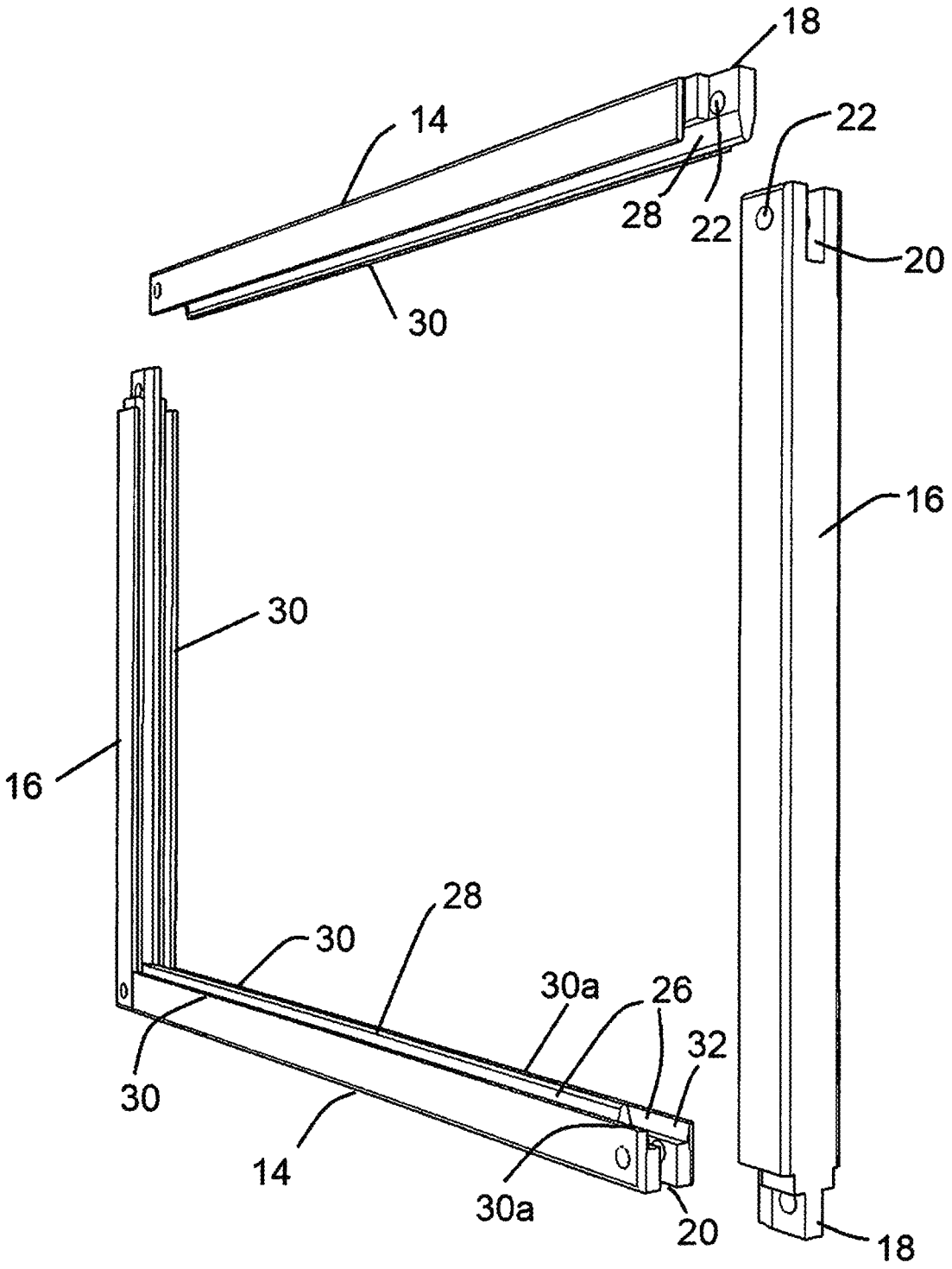
FIG. 2 is an exploded view showing four frame bars for assembly into a carrying frame.
Figure 3:
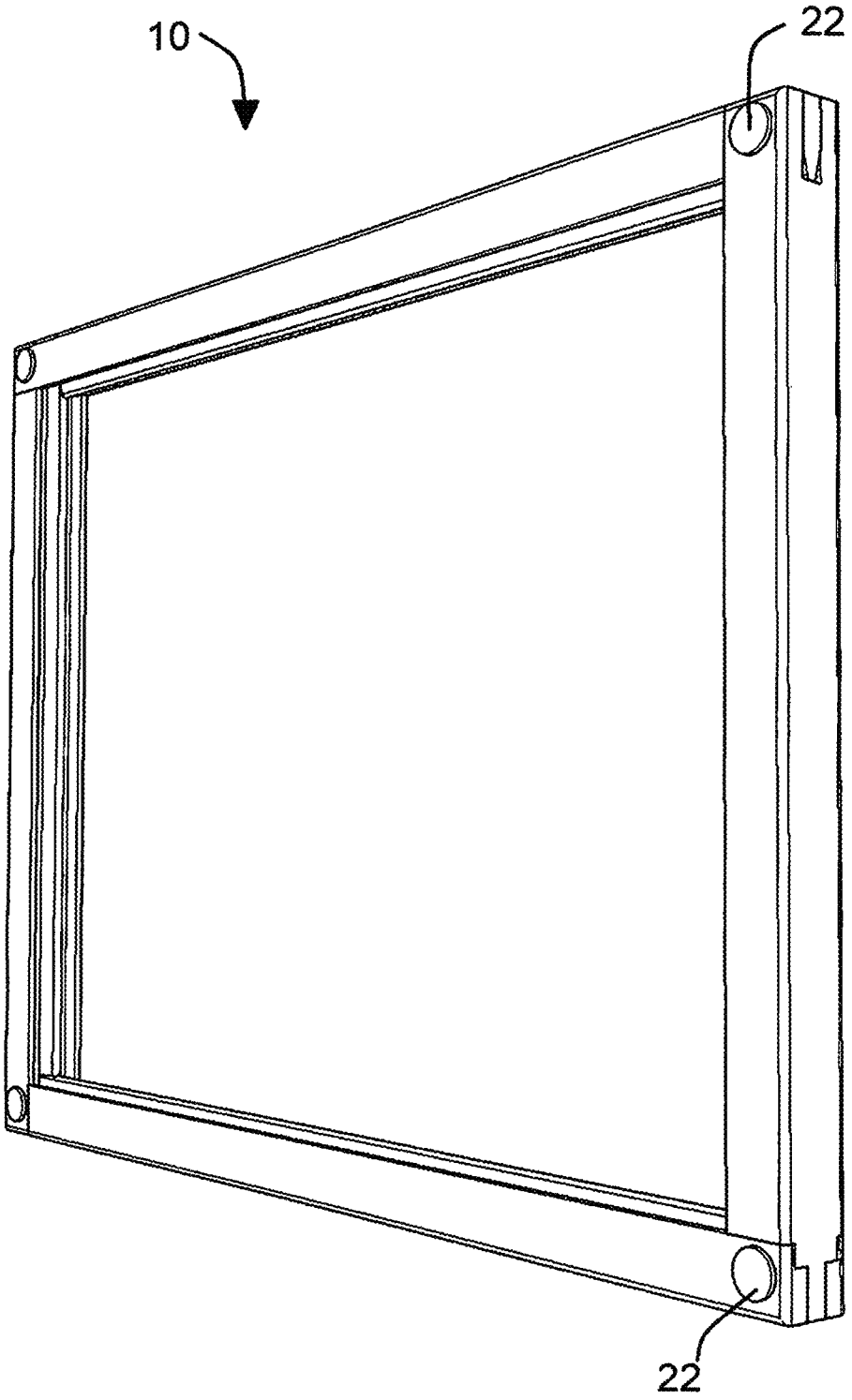
FIG. 3 is a perspective view of the frame similar to FIG. 1, without a painting and with corners not fully secured.

FIGS. 2 and 3 illustrate assembly of the carrying frame 10. The frame bars 14 and 16 are selected by the artist for the painting to be carried, such as 8×10 inch, or 11×14 inch. In a preferred embodiment each of the frame bars has first and second ends configured differently, i.e. "male" and "female" ends. This can be called tongue and groove corner joint, or, more accurately, a rabbet corner joint. A tongue 18 on the first end of a frame bar fits closely into a groove or slot 20 in the forked second end of an adjacent frame bar at right angles, to form the corner. Holes 22 have been bored through the preferably wood frame bars, to receive a pin when the holes are all aligned, with the tongue in the slot. A form of pin is shown in FIG. 1 at 24. In the assembled view of FIG. 3 pins have not been inserted through the holes 22.

The painting carrying frame 10 illustrated here is configured to receive canvas panels rather than stretched canvases, such panels having a typical thickness of about ⅛", sometimes thinner. However, as discussed below, a wider version of the frame bars can accommodate stretched canvases, or cradled canvases, which are panels typically glued to a wooden frame. For the carrying frame as seen in FIGS. 1 to 4, the frame bars can be formed of pine or poplar, for example, for light weight and about ¾" or less in width; in one preferred form the frame bars are each 23/32" square, which can be formed by routing square wood stock of those dimensions or larger. Other materials could be used for the bars, such as extruded metal or plastic.

Figure 6:
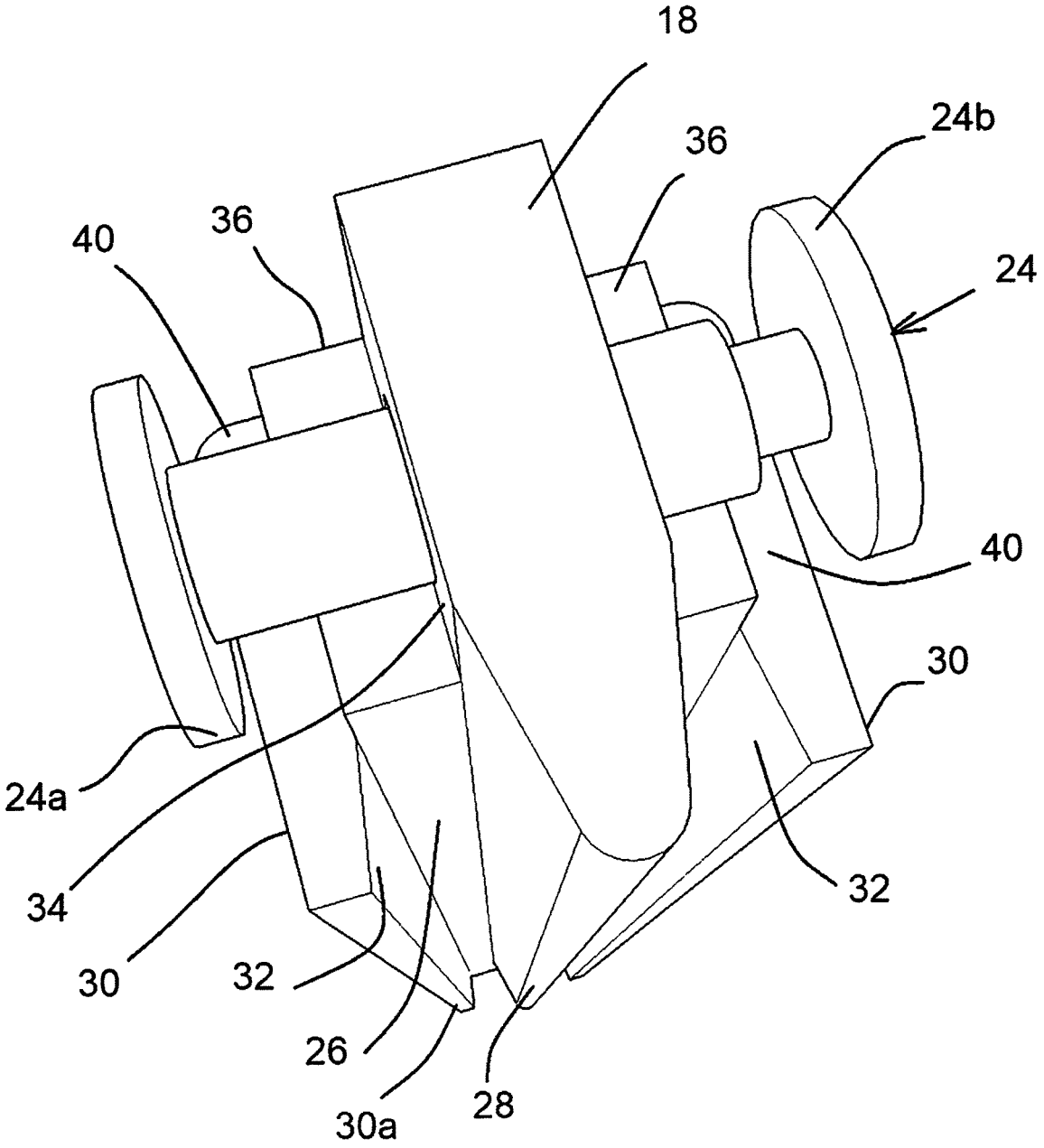
FIG. 6 is a perspective view particularly illustrating one end of a frame bar.

As can be seen in FIG. 2, the canvas panels are retained in the frame via two parallel channels or grooves 26, each preferably tapered to a narrow dimension deep in the groove. FIG. 6 shows this configuration in greater detail. The grooves or channels 26 are formed by an elongated central divider ridge 28 which, as seen in the drawing, preferably extends out as a continuous cross section to form part of the extending tongue 18 at the first end of each bar. Spaced away from the central divider 28 are outer flanges 30, these forming the two channels or grooves 26 along with the central divider ridge 28.

Figure 4:
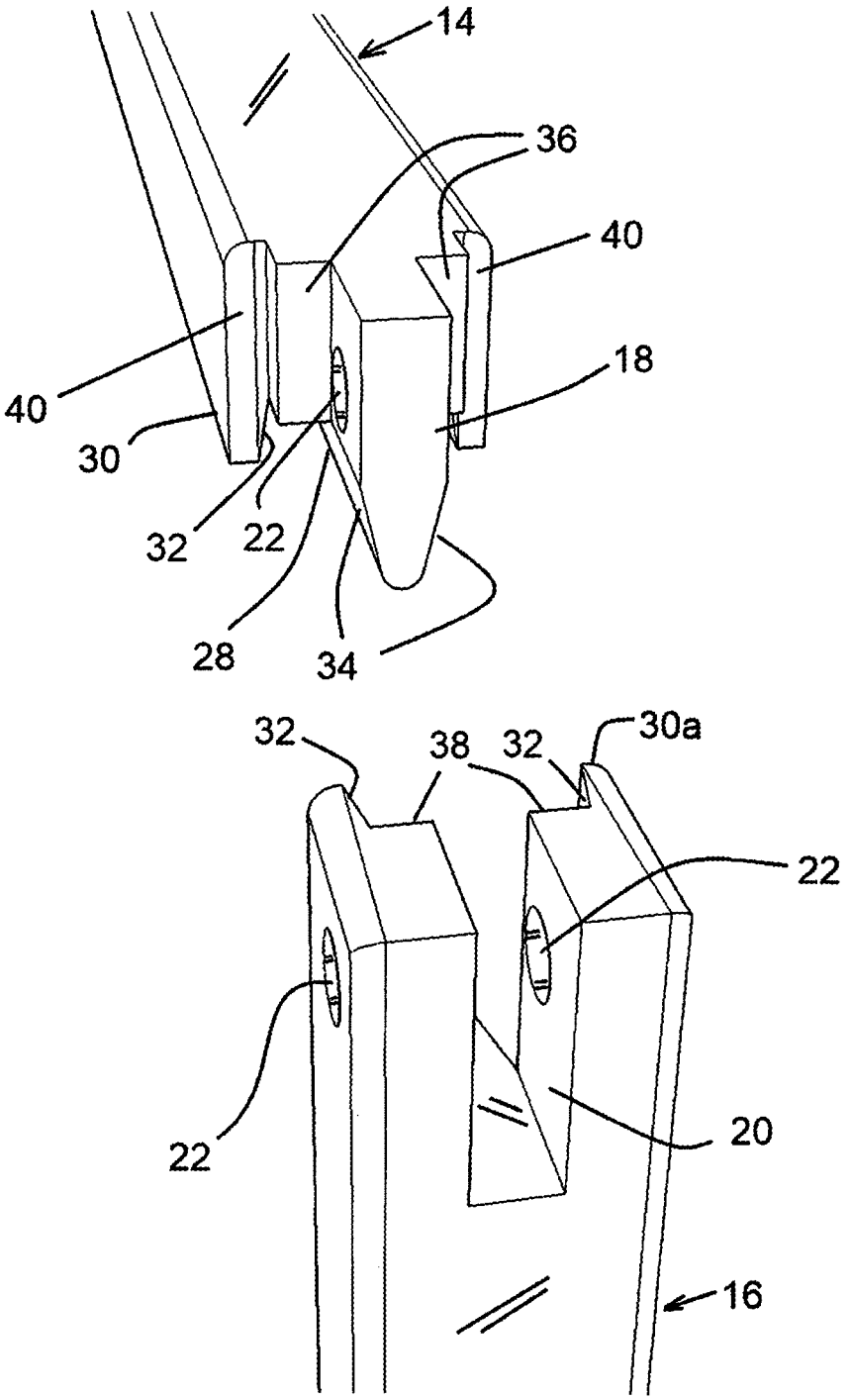
FIG. 4 is a detailed perspective view showing the detail of a corner connection.
Figure 5:
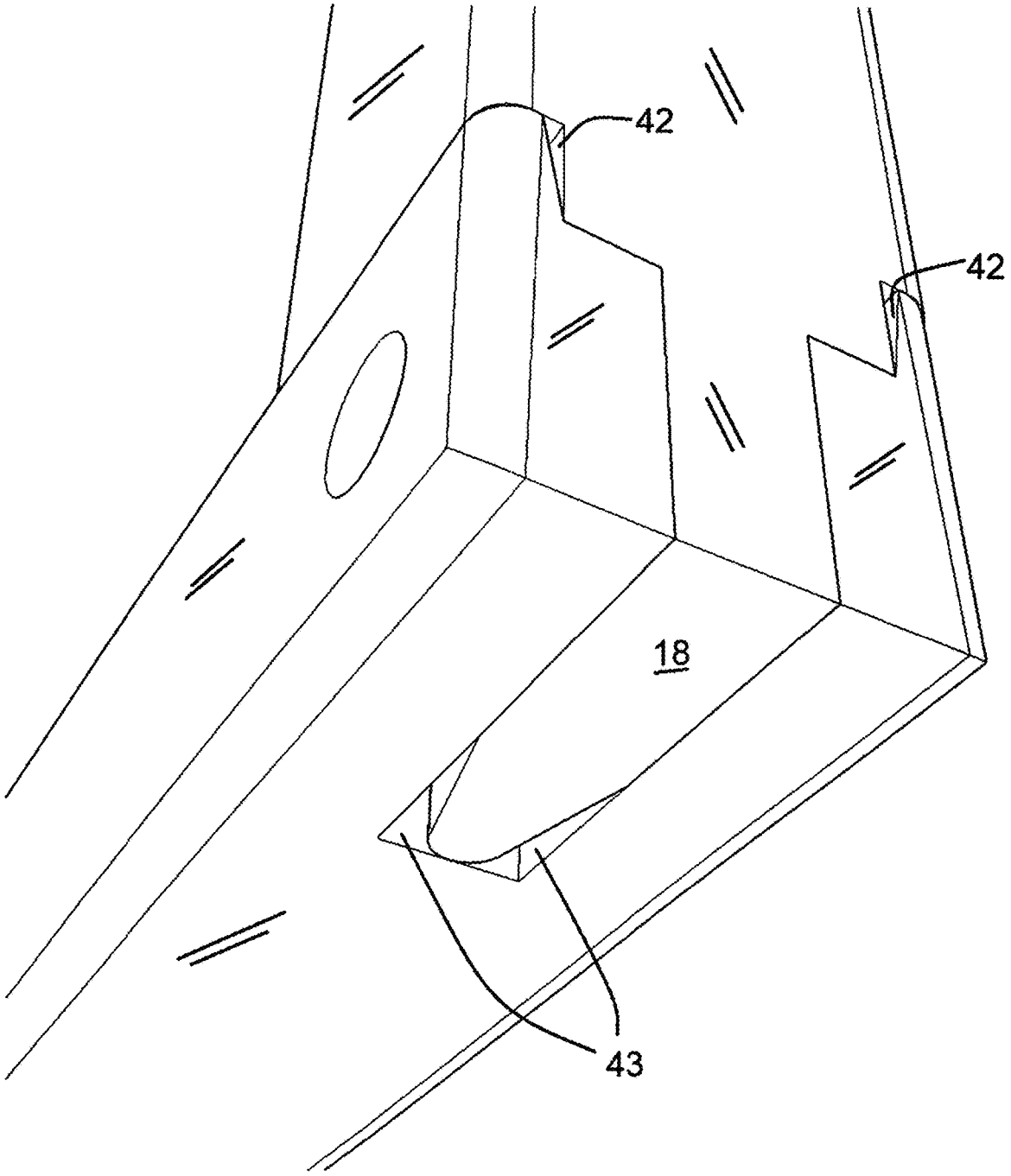
FIG. 5 is a perspective view of a portion of the frame with a corner detail.

FIGS. 4 and 5 detail the connection of a corner joint of the carrying frame. The tongue 18 has a width that fits closely in the slot 20, and typically friction alone can be relied on for holding the corners together, although the use of a securing pin is preferred. Other means can also be used to hold the bars in assembled position, such as heavy duty rubber (or other elastic) bands, VELCRO strips, a belt or tie-wraps. Other devices could be used such as tape on the corners, or wire. The corners could be held together with a rubber or elastic band at each corner, strung at about 45° over the corner joint and engaged in transverse notches in the bars, with a notch about an inch or two back from the joint, at each end of each bar.

The deeper-narrowing taper in each of the canvas-receiving slots or channels 26 is effected by sloped inner sides 32 on the outer flanges 30, and by tapering sides 34 on the central divider ridge 28. Although the corner joint geometry could be in several different forms, this preferred embodiment includes, on the first end of the bar, abutments 36, receded back along the tongue 18, that will abut against surfaces 38 of the receiving end of the adjacent frame bar. As can be seen in FIGS. 2 and 4, as well as FIG. 6, these surfaces 38 in a preferred form of the invention are a continuation of the bottom of each groove or channel 26. This geometry provides for efficient production of the frame bars by conventional cutting, tenoning, or coping or routing techniques.

Outwardly of the abutments 36, outer flange ends 40 are positioned recessed somewhat from the abutments 36, so as to abut against surfaces 30*a* of the outer flanges 30 on the adjacent frame piece 16, these ends 40 being recessed back from the abutments 36, and also an opening 43 at each side of the tip of the tongue 18. The joining of all these surfaces is better seen in FIG. 5, which includes essentially an end view of the joint being made in FIG. 4, but looking at the upper side of that joint. In FIG. 5 the joint is seen secured together by a binder post 24, better illustrated in FIG. 6. These binder posts have an outer diameter sized to closely fit within the holes 22, and comprise two screwed-together components 24*a* and 24*b*. An example of such binder posts are those produced by Kinter (K International, Inc.) of Waukegin, Ill. and shown on the website kinter.com. The posts may be of aluminum. An alternative is to use simple two-legged brass fasteners normally used to fasten papers together; they should be of appropriate size to substantially fill the diameter of the holes.

FIG. 5 also shows a feature providing for "breathing" of wet painted surfaces, by air exchange into the interior of the carrying frame when holding two paintings face-to-face. The geometry of the frame bars, and of the resulting connected corners, leaves a triangular air opening 42 at each side of the abutments 36. This occurs as a natural result of the panel-holding groove geometry, the grooves 26 being formed as continuous routings through the length of each frame bar, according to the preferred construction of the carrying pieces.

Figure 7:
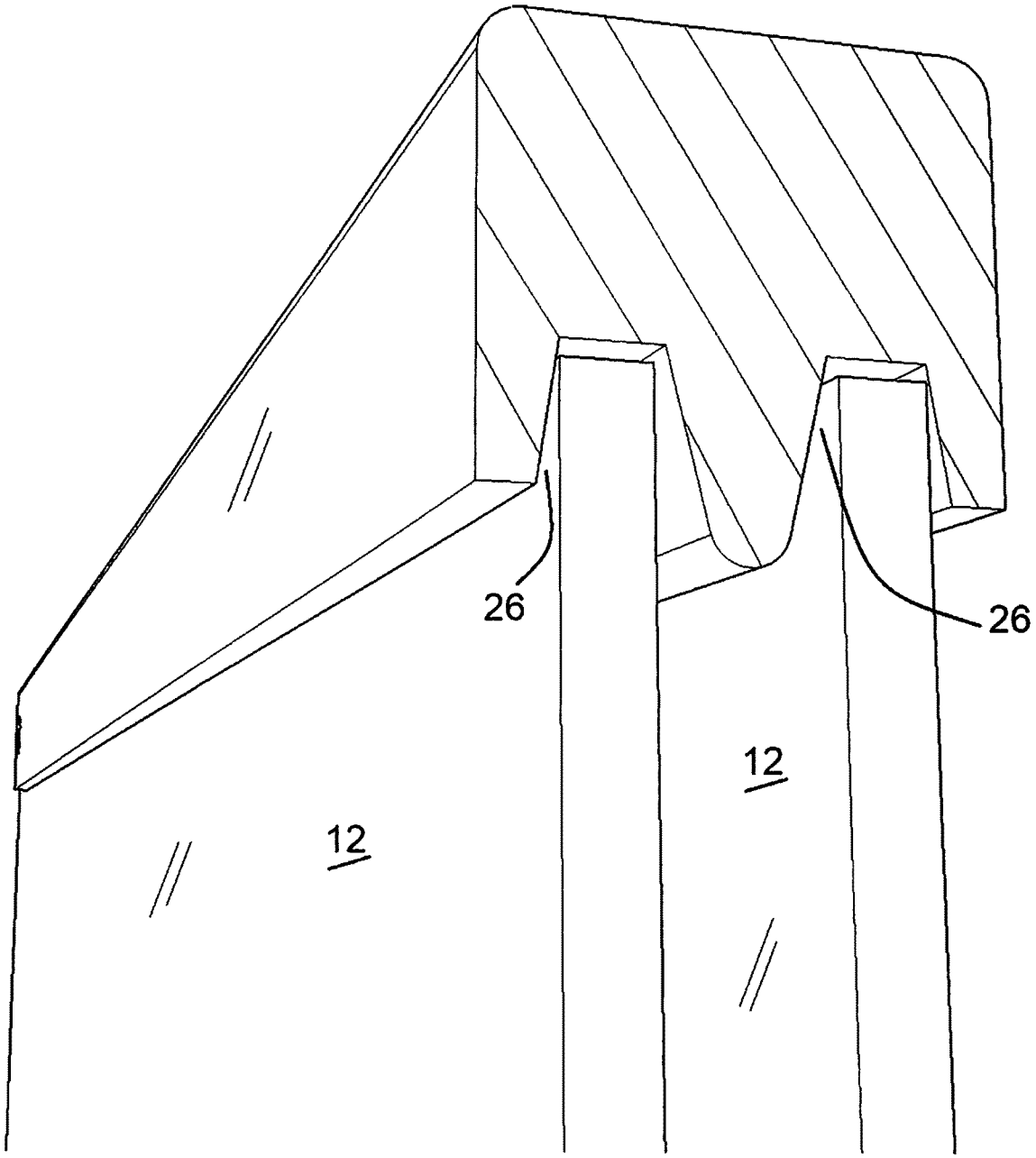
FIG. 7 is a perspective sectional view of a portion of the frame, showing retention of two canvas panels within the frame.

FIG. 7 shows a part of an assembled carrying frame, with a frame bar 14 shown in transverse cross section. The grooves or channels 26 are shown retaining a pair of canvas panels 12, which fit closely within the deep ends of the grooves 26.

Example dimensions for a frame bar such as shown at 14 in FIG. 7 are approximately 23/32" in both width and depth (preferably ¾ inch or less); 3/16 inch depth of each groove 26; ⅛ inch width across the bottom (deep end) of each groove 26; and tapers on the laterally inner sides of the side flanges 30 and also on the sides of the central divider ridge 28 of about 10°, or a range of about 8° to 20°. All these dimensions can widely vary, within limits imposed by the material used, strength requirements, convenience of use, and the need for secure retention.

Figure 8:
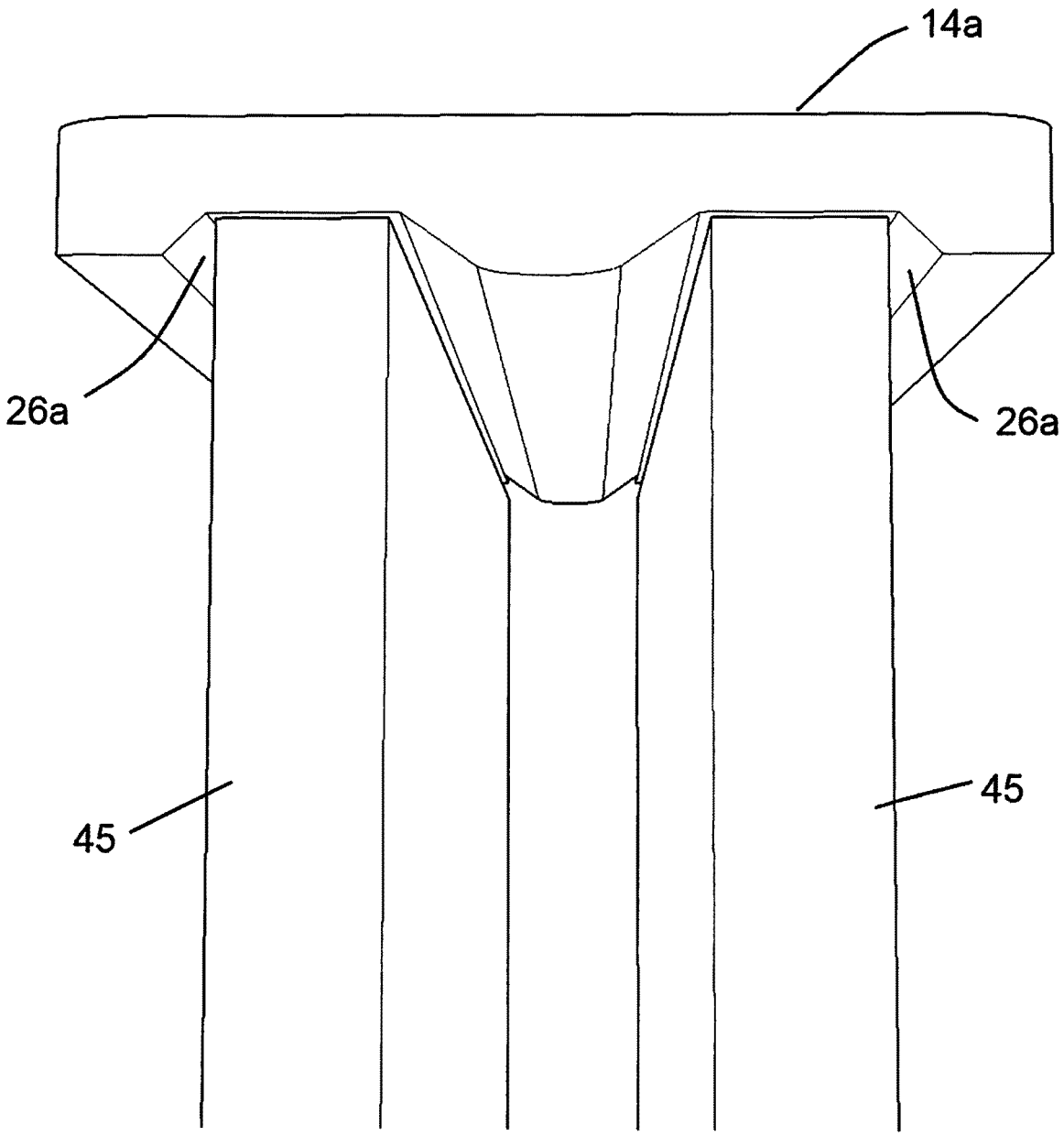
FIG. 8 is a view similar to FIG. 7 but with a wider form of frame retaining two stretched canvases.

FIG. 8 is a cross sectional view (not to scale) similar to FIG. 7 but demonstrating a wider carrying frame bar 14*a*, with wider grooves 26*a* such as to enable carrying, for example, stretched canvases 45 with ½" stretcher bars. Such a frame bar 14*a* will have a width of approximately 1¼" to 1". Frame bars can also be made for canvases with ¼" stretcher bars. If desired, frame bars could even be made with one channel wide for a stretched canvas and one channel narrower for a canvas panel.

Figure 9:
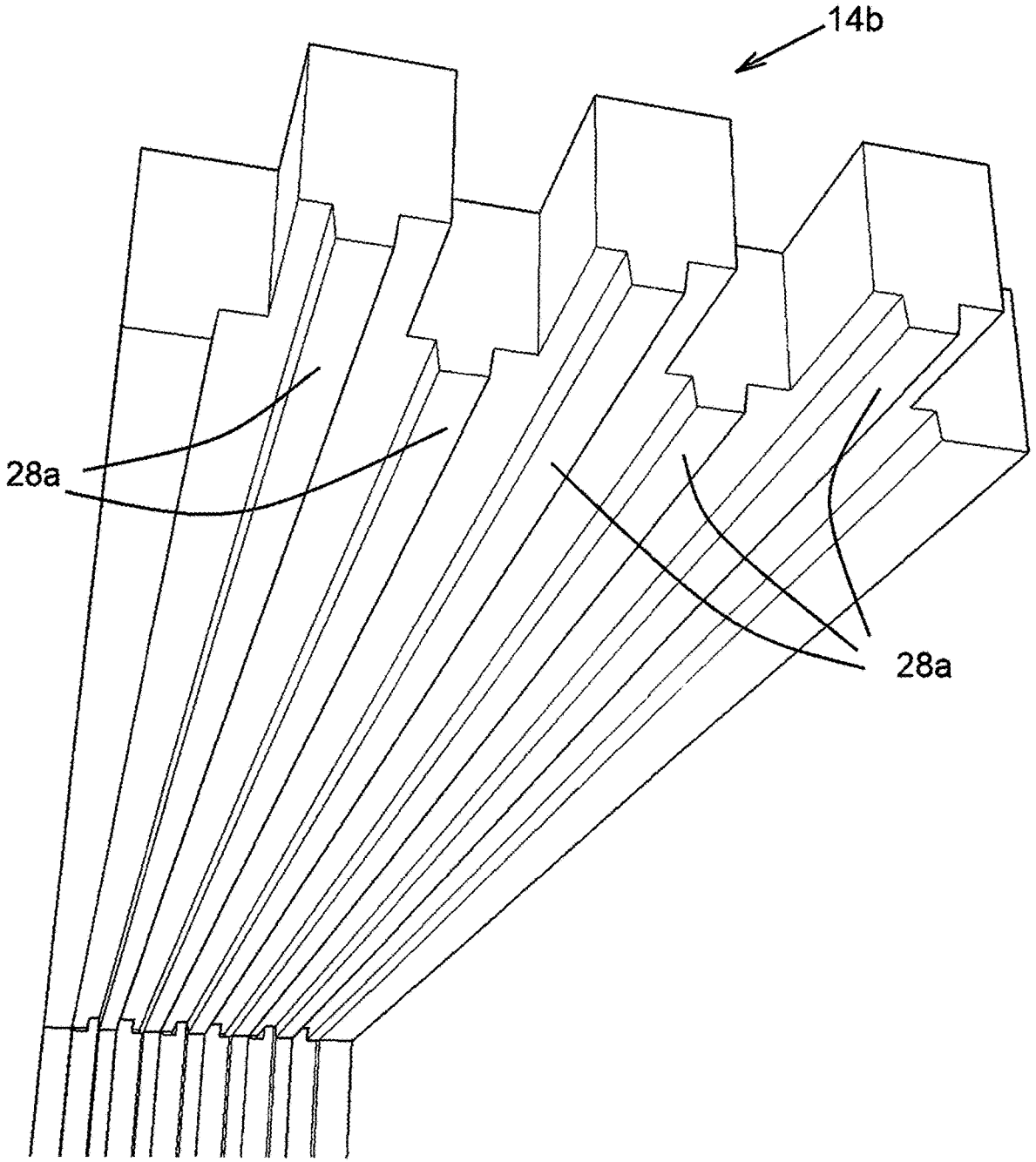
FIG. 9 is a perspective view showing frame bars for six paintings.

Although painting carrying frames and frame components described above are designed for two canvases, the frame bars could be made wider, for three or more canvases. FIG. 9 shows schematically an example frame bar 14*b* for six canvases or more, producing a carrying frame 10*a* as in FIG. 10. In that case there are five divider ridges 28*a*. Where more than two canvas-receiving channels or grooves 26 are included in the frame bars, two canvas panels can be placed in some of the channels, provided the channels are configured large enough to receive two panels. Thus, if three channels are included, the center channel can hold two panels back-to-back. The frame of FIGS. 9 and 10 can hold ten canvases, doubled in each of the interior channels and single/facing inwardly in each of the outer channels. In the example shown, rather than each divider ridge forming a narrow tongue extending at its end (five tongues), only three tongues extend from a first end of the bar to be received in three mating slots the adjacent bar's second end, in a triple rabbet connection. Two tongues could be used, in a double rabbet corner connection. Description of two parallel grooves or two canvases herein or in the claims is not to preclude frames and frame bars designed for a larger number of canvases.

Figure 10:
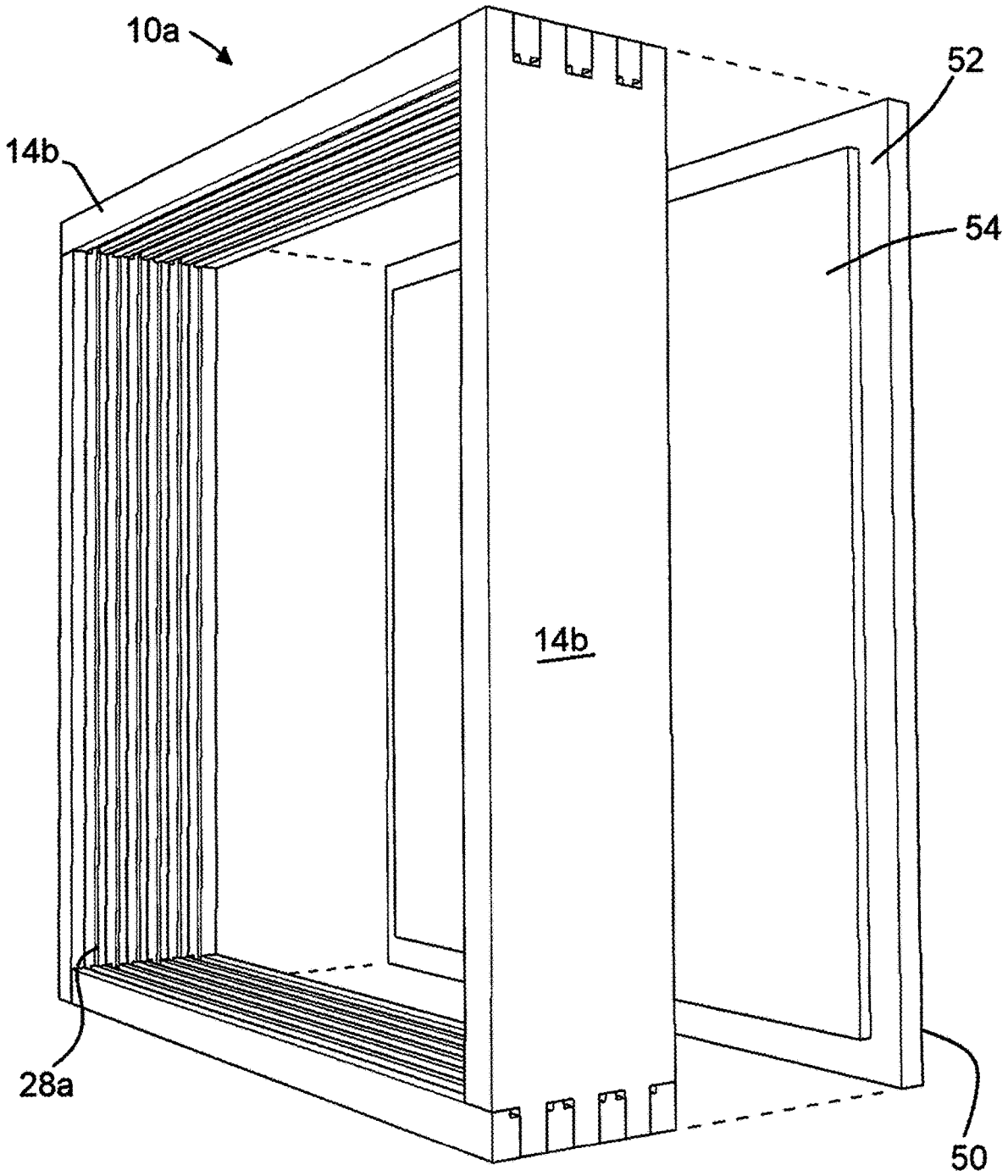
FIG. 10 is a perspective view showing a carrying frame assembled from frame bars as in FIG. 9.

FIG. 10 also shows that a cover can be provided to be attached to a carrying frame 10*a* (or 10). Two of the covers 50 can be provided, one for each open side of the frame, for the purpose of shipping paintings within the frame. As illustrated, the cover 50, which can be of plywood, will preferably have a recess 52 cut out on one side of the perimeter, so that a thicker part 54 of the cover 50 will fit into the open side of the frame 10*a*, closely fitted to the opening. As an example, the cover 50 can be formed of ⅜ inch, ½ inch or ¾ inch thick plywood, with, for example, a ¼ inch deep recess 52. The thick part 54, inserted into the open side of the frame, adds substantial torsional strength to the wood perimeter, to resist any potential crushing of the box. The covers provide additional support to the joints of the wood frame, shouldering a substantial amount of the torsional load and making the box more secure.

With covers installed, two more paintings can be retained in the frame, since each cover will protect a painting facing outwardly.

For securing the covers on the frame, a tee-nut could be inserted into one side of the plywood cover 50 at each corner, and holes could be drilled transversely through the corner joints, with a bolt inserted through the opposing plywood cover to engage in the tee-nut. This will add substantial strength to the resulting shipping box. Not only canvas panels, but stretched canvas paintings can be shipped in carrying frames of the invention made into shipping boxes. For larger works of art, cross braces can be attached to the plywood to provide additional support, and the carrying frame bars could be made of heavier wood if needed.

Figure 11:
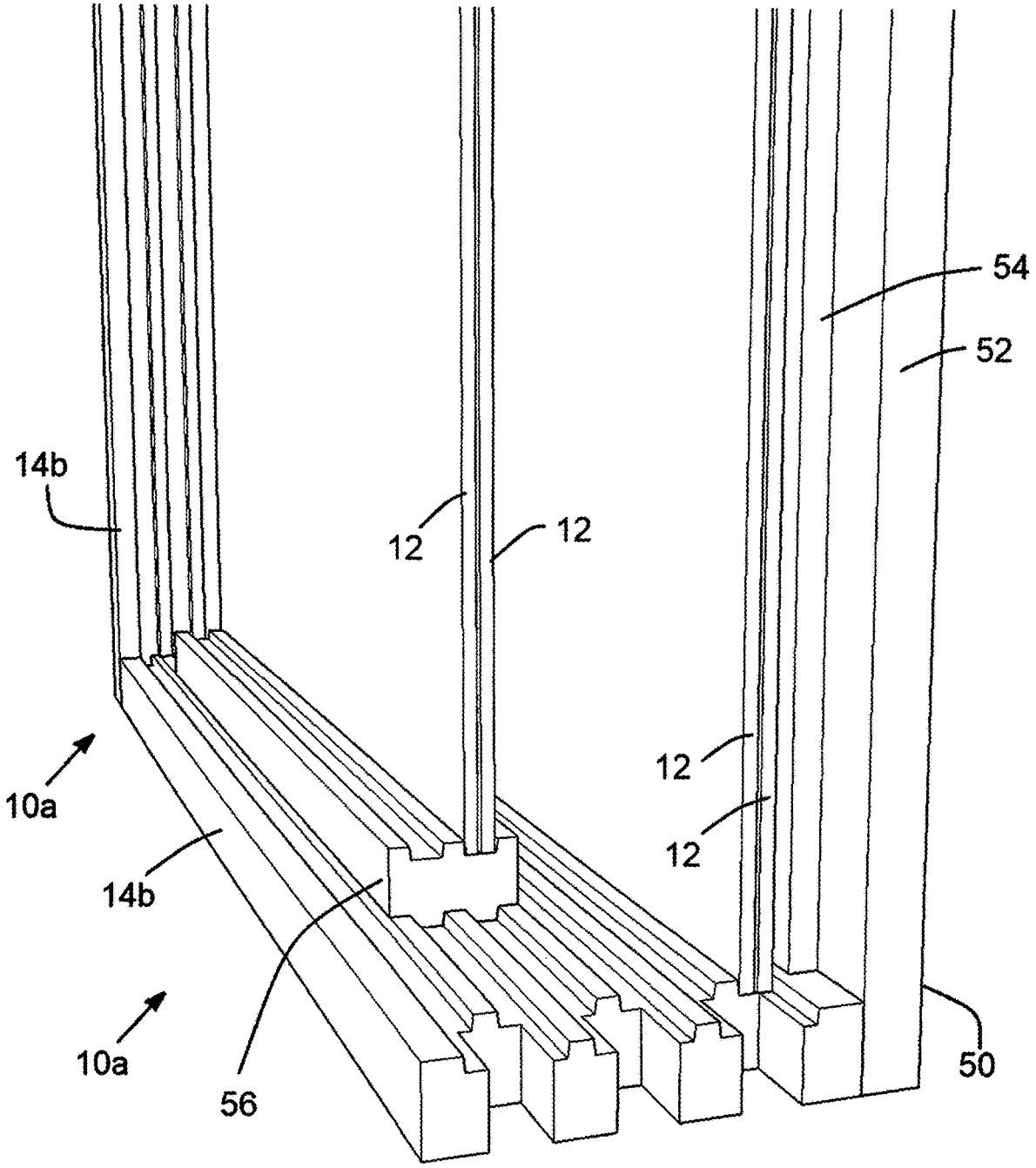
FIG. 11 is a partial view in perspective showing a carrying frame with mated spacers to accommodate smaller canvases within the carrying frame.

FIG. 11 shows a part of a carrying frame 10*a*, which optionally can have side covers 50 for shipping, but FIG. 11 also shows features that apply to carrying frames as discussed above. See also FIG. 12. Frame bars 14*b* are fitted with selected mated spacers 56 at bottom and optionally also at top. These provide for retaining smaller canvas panels or canvases within the carrying frame, and in FIG. 11 canvas panels 12 are shown back to back in the frame. One pair is received directly in a channel of the frame bar 14*b* and one pair is received in a mated spacer 56. Although a double-channel mated spacer 56 is shown in these drawings, a single-channel mated spacer can be provided. It is sufficient that the canvas panels 12 (or stretched canvases) be closely received in channels at top and bottom of the frame and, at least as a carrying frame, there is no requirement that the smaller panels 12 be restrained from movement in the direction parallel to the channels. For shipping, however, an appropriate form of restraint would be recommended.

Figure 12:
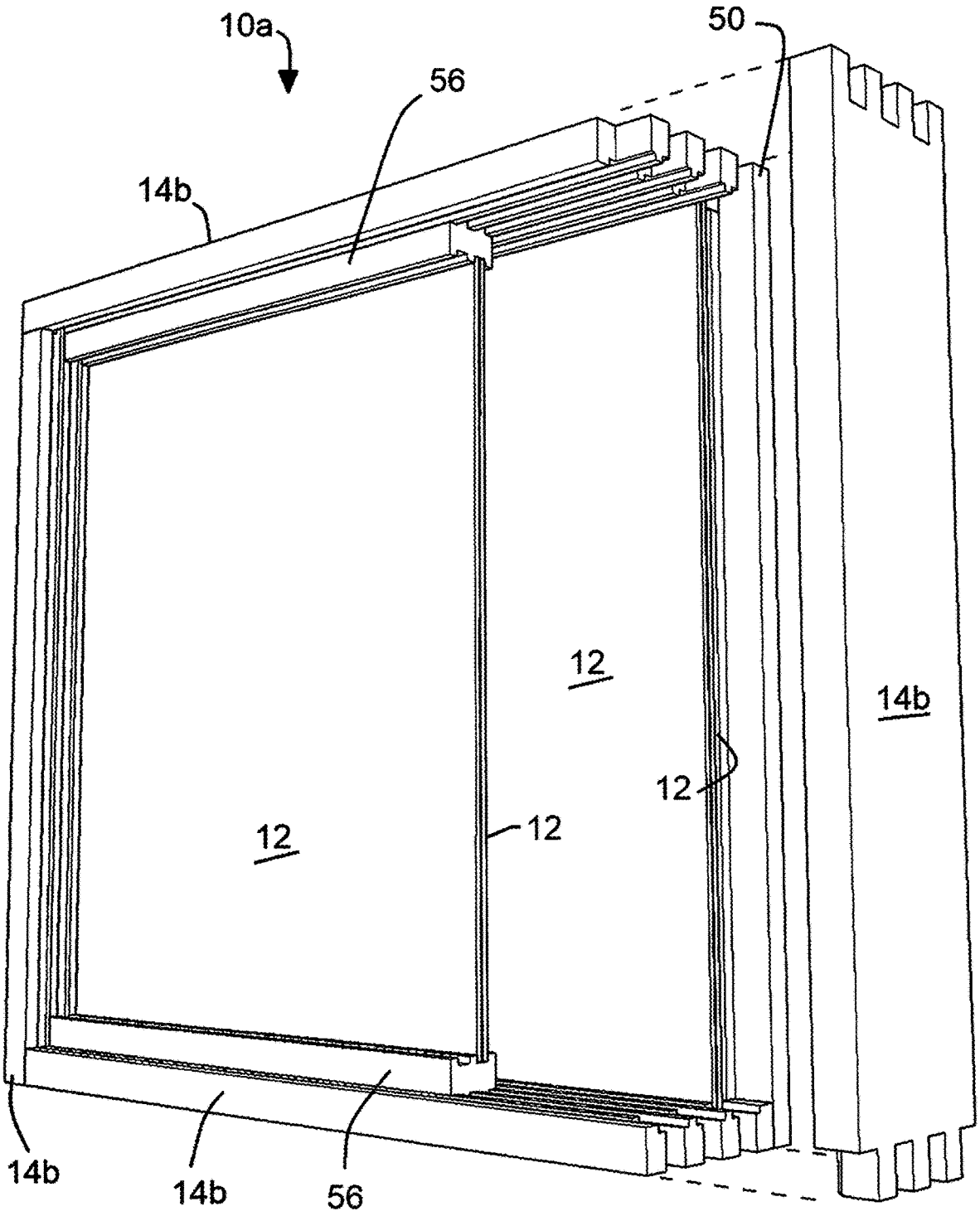
FIG. 12 is a full view in perspective showing the carrying frame apparatus of FIG. 11.

FIG. 12 shows the carrier frame 10*a* in full, and indicating assembly of the fourth frame bar 14*b* to complete the frame. As in FIG. 11, a cover 50 is shown, two of which would normally be provided for shipping. However, the assembly 10*a* can be without the cover 50, to serve simply as a carrying frame. FIG. 12 shows, as an example, that a mated spacer 56 can be used at both top and bottom of the smaller panels 12, for a particular height of panel.

Figure 13:
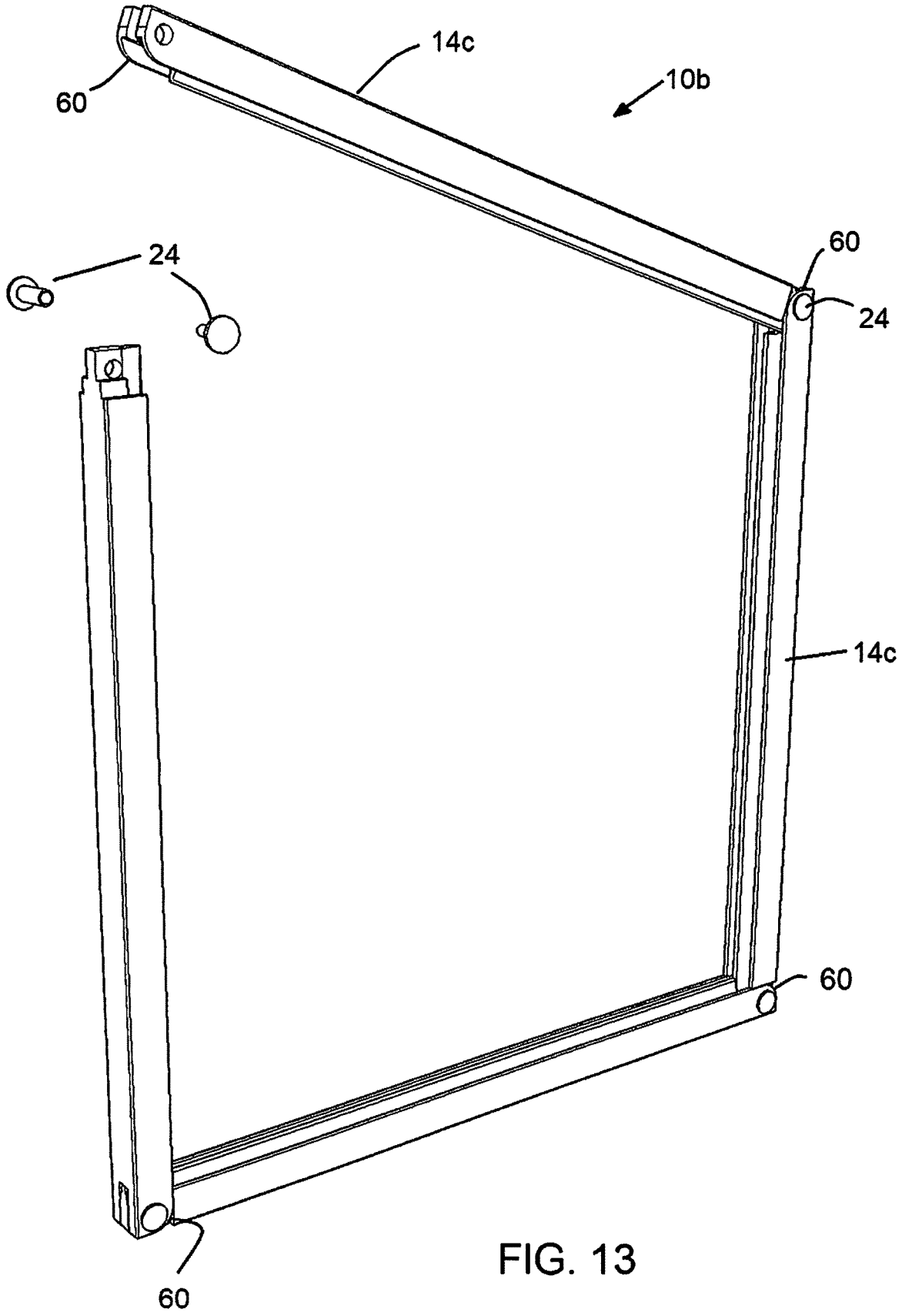
FIG. 13 is a perspective view showing a carrying frame having a further feature.

An alternative, optional feature is shown in FIG. 13. In that view a carrying frame 10*b* is assembled from bars 14*c*, each of which has one end with a rounded corner 60. This enables the user to remove only one of the binder posts 24, then to swing open one of the frame bars 14*c* as illustrated. This provides full access to the panels or paintings held in the frame. A panel can then be removed or inserted, after which the frame can be re-closed and the binder post re-inserted. As explained above, other corner retention devices can be used, rather than the screw-threaded binder posts 24 shown. On initial assembly of the frame, all four frame bars can be connected together, but with one bar swung open until all paintings are inserted, then the fourth corner closed.

Although the preferred construction of the carrying frame bar is such as to have male and female ends, each bar could have identical ends if desired, so as to be a dedicated bar that must be mated with two bars having ends of the other configuration. If the joint configuration is as shown in U.S. Pat. No. 6,757,997, that form of identical ends will mate with either end of a similar bar, maintaining versatility in connecting any bar to any other bar. Note that even 45° angled miter joints can be used, with a secure form of corner retention, which could involve holes and pins and/or rabbets, or pegs and holes in the angled faces or a corner gripping device such as a rubber band engaged in grooves of each frame bar at a corner, as mentioned above.

The terms "inner" and "inward" used herein in reference to the carrier frame and frame bars and their structural components are generally indicating inward of the frame, i.e. toward the painting(s) to be carried. Inner sometimes refers more locally to features such as the inner side of a channel, i.e. laterally inner. "Outer" or "outward" typically is used in reference to the width of a bar, as in the outer flanges, meaning laterally outer. Inwardly is used in a somewhat different sense when referring to two paintings facing inwardly, toward one another.

The above described preferred embodiments are intended to illustrate the principles of the invention, but not to limit its scope. Other embodiments and variations to these preferred embodiments will be apparent to those skilled in the art and may be made without departing from the spirit and scope of the invention as defined in the following claims.

I claim:

1. An artist's painting carrier for carrying a plurality of paintings with the painting surfaces protected, comprising:

four linear frame bars that can be assembled into a carrier frame, each frame bar having two ends, each end adapted to be connected directly to an end of another frame bar with the frame bars at right angles to form a right-angled corner, releasable corner connecting means for securing ends of the frame bars together at corners of a carrying frame, each frame bar having, on an inner side to face toward edges of paintings to be retained, an elongated longitudinally-extending central divider ridge extending inwardly, in a position to divide and separate two paintings, and two elongated outer flanges parallel to the central divider ridge and extending inwardly, forming two edge-receiving channels, one on either side of the central divider ridge to receive an edge of a painting, and the releasable corner connecting means including each frame bar having a first end with a longitudinally-extending tongue and a second, opposite end having a groove configured to receive such an extending tongue from another frame bar connected at a right-angled corner, whereby a frame can be partially assembled using the frame bars, one or more paintings can be inserted into the edge-receiving channels of the partially assembled frame, and the frame can then be completed, secured together by the corner connecting means to securely hold paintings facing inwardly so that painted surfaces are protected.

2. The carrier of claim 1, wherein the corner connection means comprises a screw threaded binder post the binder post having two components screw-threaded together through aligned holes in overlapping ends, through a tongue and a groove of two connected frame bars.

3. The carrier of claim 1, wherein the central divider is tapered in thickness, to a narrowest thickness at an inner edge toward the interior of the frame.

4. The carrier of claim 3, wherein the outer flanges are tapered so that each edge-receiving channel tapers to a narrower dimension as the edge of a painting is inserted inwardly into the channel.

5. The carrier of claim 1, wherein the frame bars are made of wood.

6. The carrier of claim 1, wherein the groove in the second end of the frame bar comprises a slot in the second end having a width to match that of the tongue, so that the second end is forked.

7. The carrier of claim 6, wherein the second end has aligned transverse holes traversing across the slot, and the tongue at said one end of the frame bar having a transverse hole so that the holes of the tongue and of the second end are aligned when two frame bars are put together at right angles, to receive a cylindrical connecting pin through the aligned holes, serving as said corner connecting means.

8. The carrier of claim 1, wherein the frame bars are configured at their ends to provide small openings at corners of the frame that allow ambient air to reach the painted surfaces of paintings contained in the frame.

9. The carrier of claim 6, wherein the extending tongue comprises an extension of the elongated divider ridge and includes a cross sectional shape the same as the divider ridge.

10. The carrier of claim 9, wherein in the assembled frame at a corner, the inner side of the tongue of one frame bar nests against a deep end or bottom of the slot in the second end of the other frame bar, with the width of the tongue engaged in the slot of said second end, and with ends of the elongated outer flanges of the one frame bar engaged against inner edges of the elongated outer flanges at said second end of the other frame bar, whereby a strong and secure corner joint is formed.

11. The carrier of claim 10, wherein said first end of the one frame bar includes two abutments, one on either side of the tongue and receded back from the tongue, positioned to engage against surfaces on the other frame bar that are extensions of the bottoms of said edge-receiving channels, and with ends of the elongated flanges of the one frame bar receded still farther back from the abutments.

12. The carrier of claim 1, wherein each frame bar is cut from wood with continuous cutting or routing through the length of the bar to produce said center divider ridge and two outer flanges continuous through the length of the bar, and by transverse cuts or routs to produce the extending tongue to include an extension of the central divider ridge and to remove material such that the elongated outer flanges are shortened, to have ends receded back from the end of the tongue, and to form said slot in said second end, removing a portion of the center divider ridge at the second end.

13. The carrier of claim 1, wherein the edge-receiving channels are sized to receive canvas panels approximately ⅛ inch in thickness.

14. The carrier of claim 1, wherein the edge-receiving channels are sized to receive stretched canvases having ¼ inch or greater stretcher bar thickness.

15. The carrier of claim 1, further including a pair of cover plates adapted for attachment to the two opposing open sides of the assembled carrier frame, with securing means for attaching the cover plates to the carrier frame at corners, whereby the frame is closed and can be used for shipping paintings held in the carrier frame.

16. The carrier of claim 1, further including at least one mated spacer having one surface mated to nest in an edge-receiving channel of a frame bar and an opposite surface providing an edge-receiving channel positioned to receive an edge of a painting, whereby one or more mated spacers can be placed in one or more frame bar channels and a painting of smaller dimension than accommodated by the edge-receiving channels of the frame bars of the assembled painting carrier can be securely held in the frame.

* * * * *